United States Patent [19]

Fujiya

[11] Patent Number: 4,530,532

[45] Date of Patent: Jul. 23, 1985

[54] UNLATCHING DEVICE FOR LATCH OF REFRIGERATION CHAMBER OR THE LIKE

[76] Inventor: Toshimichi Fujiya, No. 4-22, Kounandai 6-chome, Kounan-ku, Yokohama-shi, Kanagawa-ken, Japan

[21] Appl. No.: 471,260

[22] Filed: Mar. 2, 1983

[51] Int. Cl.[3] ..... E05B 15/02

[52] U.S. Cl. ..... 292/341.15; 292/DIG. 65; 292/DIG. 71

[58] Field of Search ..... 292/341.15, 341.17, 292/257, 340, 98, 111, DIG. 65, DIG. 71, DIG. 44, DIG. 31; 70/208

[56] References Cited

U.S. PATENT DOCUMENTS

| | | | |
|---|---|---|---|
| 416,359 | 12/1889 | Cooley | 292/257 |
| 1,971,401 | 8/1934 | Fuchs | 292/DIG. 71 |
| 2,747,906 | 5/1956 | Emmert | 292/DIG. 65 |
| 2,762,645 | 9/1956 | Bordner, Jr. | 292/341.17 |
| 3,024,472 | 3/1962 | Hardenbrook | 292/257 X |

*Primary Examiner*—Gary L. Smith
*Assistant Examiner*—Thomas J. Dubnicka
*Attorney, Agent, or Firm*—Martin Smolowitz

[57] ABSTRACT

An indoor unlatching device for latch device of a refrigeration chamber door, comprising an operation rod extending through a frame wall of the door and connected at its outer end to a latch support and a manipulation handle connected to the inner end of the operation rod by means of a pivot shaft and having a first contact surface and a second contact surface selectively contactable with a handle seat surface, the distance between said first contact surface and said pivot shaft being greater than the distance between said pivot shaft and said second contact surface. In the normal state, said first contact surface is held in contact with said handle seat surface to pull and hold said latch support on the outer surface of said frame wall. In the case of emergency, said handle is rotated to bring said second contact surface into contact with said handle seat surface to lift said latch support away from said outer surface of said frame wall, thereby to disengage said latch support from a latch of said latch device.

The unlatching device permits an easy unlatching operation with small force and, hence, a prompt unlatching and easy opening of the door.

4 Claims, 14 Drawing Figures

UNLATCHING DEVICE FOR LATCH OF REFRIGERATION CHAMBER OR THE LIKE

BACKGROUND OF THE INVENTION

The present invention relates to a latch for use on the door of a refrigeration chamber or freezing chamber and, more particularly, to an unlatching device arranged for unlatching the door latch from the indoor side.

In the refrigeration chambers of walk-in type, it is essential from the view point of safety that anyone who has happened to be confined in the chamber due to a careless locking operation by another person or an accident can unlatch the latch to open the door by himself from the indoor side.

To cope with this demand, hitherto such a safety unlatching device has been used in which a threaded rod projected from the rear side of a latch support is extended through the frame wall of the chamber and a nut screwed to the inner projected end of the threaded rod. Anyone who is confined in the chamber can disengage the latch support from the latch of the latch device by pushing outwards the threaded rod to make the latch support move away from the outer surface of the chamber wall, after fully retracting the above-mentioned nut towards the inner end.

According to this arrangement, however, it is necessary to rotate the nut by a large number of turns to retract the nut to a position where it permits the disengagement of the latch support from the latch. In addition, a considerably large force is required to rotate the nut on the threaded rod because of icing on the threaded rod or nut. For these reasons, a long time is inevitably required for anyone accidentally confined in such a chamber to escape from the chamber.

SUMMARY OF THE INVENTION

Accordingly, it is a principal object of the invention to provide an indoor unlatching device which is improved to permit an easy unlatching operation with small force and, hence, a prompt unlatching and easy opening of the door.

To this end, according to the invention, there is provided an unlatching device for latch device for a door of a refrigeration chamber or the like, comprising an operation rod extending through the frame wall for said door between the exterior and interior of said refrigeration chamber or the like, said operation rod being connected at its outer end to a latch support of said latch device; and a manipulation handle connected to the inner end of said operation rod by means of a pivot shaft extending in parallel with said frame wall, said manipulation handle having a first contact surface and a second contact surface selectively contactable with a handle seat surface adjacent to the inner surface of said frame wall, the distance between said first contact surface and said pivot shaft being greater than the distance between said pivot shaft and said second contact surface, wherein, in the normal state, said first contact surface is held in contact with said handle seat surface to pull and hold said latch support on the outer surface of said frame wall, while, in the case of emergency, said manipulation handle is rotated to bring said second contact surface into contact with said handle seat surface to lift said latch support away from said outer surface of said frame wall, thereby to disengage said latch support from a latch of said latch device.

The invention will be more fully described hereinunder with reference to the accompanying drawings.

BRIEF DESCRIPTION OF THE DRAWINGS

FIG. 14 is a sectional view taken along line 14—14' of FIG. 12.

DESCRIPTION OF THE PREFERRED EMBODIMENT

Figure 1:
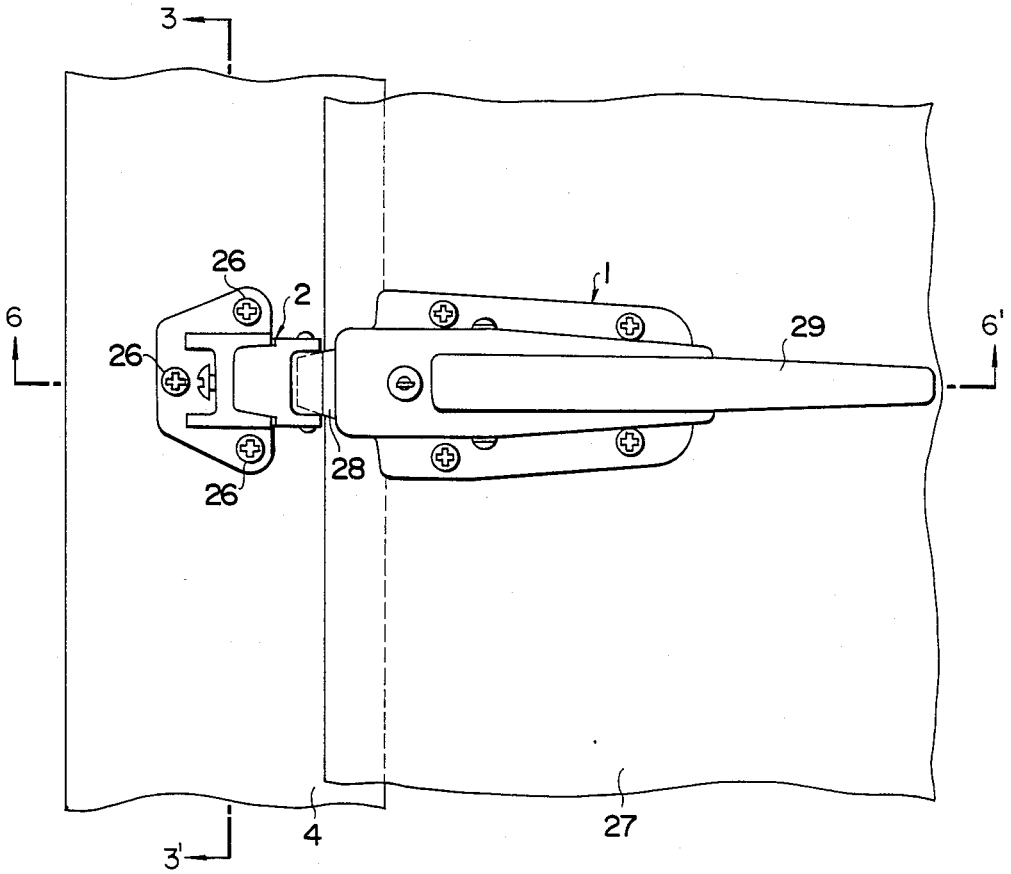
FIGS. 1 and 2 are a front plan view of an essential part and a bottom elevational view of a refrigeration chamber provided with a door latch device.
Figure 2:
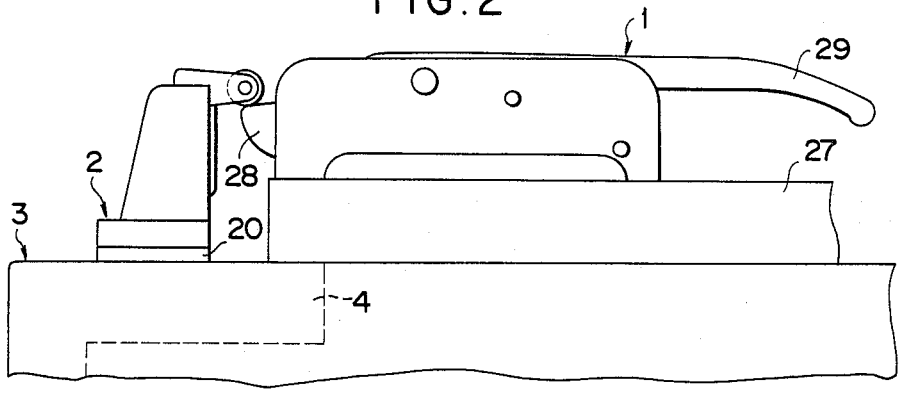
Figure 3:
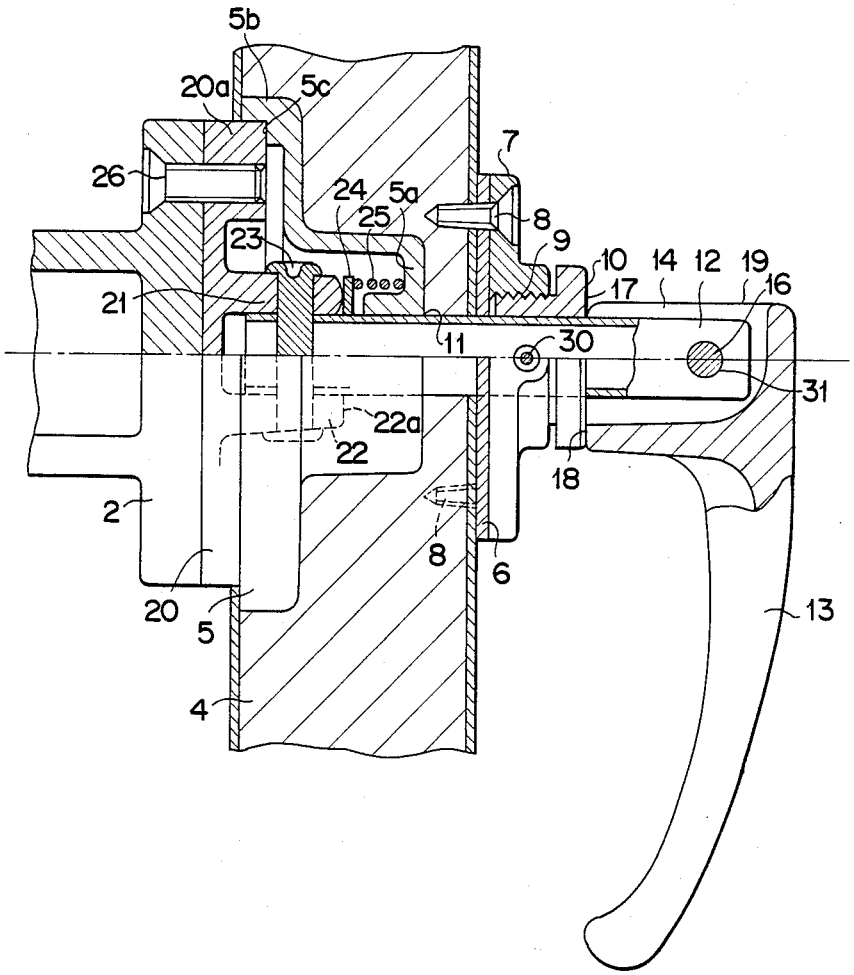
FIG. 3 is a sectional view of an essential part of the latch device taken along the line 3—3 in FIG. 1, showing the detail of an indoor unlatching device in accordance with an embodiment of the invention.
Figure 4:
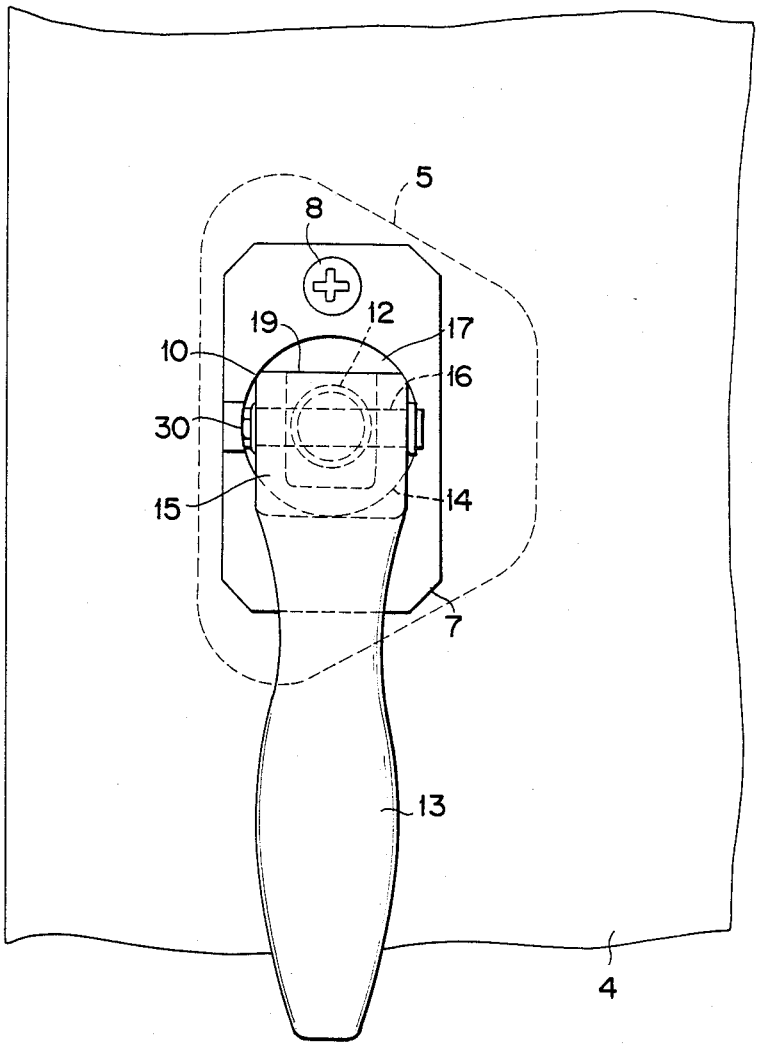
FIG. 4 is a rear plan view of the unlatching device shown in FIG. 3.

As shown in FIGS. 1 thru 4, a latch device 1 for use in a refrigeration chamber or the like has a latch support 2 which is adapted to be secured to a frame wall 4 of the chamber wall 3. A case 5 is embedded in a portion of the frame wall 4 adjacent to the outer surface of the latter. As seen in FIG. 3, a handle support 7 is attached to the inner surface of the frame wall 4 through a rubber packing 6 by means of screws 8. An adjusting sleeve 10 is screwed to a central threaded hole 9 formed in the handle support 7. A hole 11 is formed in the center of the inner bottom **5*a* of the embedded case 5. A cylindrical operation rod 12 is extended through the adjusting sleeve 10 and the central hole 11 for free sliding motion in the direction perpendicular to the frame wall 4, i.e. from the inside to the outside of the refrigeration chamber. The adjusting sleeve 10 is adapted to be fixed at a predetermined insertion depth or position by means of a tightening screw 30 which is screwed to a threaded hole 32 perpendicular to the sleeve 10**.

The operation rod 12 has an inner end disposed between left and right walls 14 and 15 of the base end of the manipulation handle 13 and is pivotally connected at the inner end to both side walls 14 and 15 by means of a pivot shaft 16 which extends in parallel with the frame wall 4 through a horizontal bore 31. The inner end surface of the adjusting sleeve 10 of the handle support constitutes a seat surface 17 for the handle.

When the manipulation handle 13 is disposed along the frame wall 4, the first contact surface 18 of the base end of the mamipulation handle 13 contacts the handle seat surface 17 while, when the manipulation handle 13 is disposed at a right angle to the frame wall 4, the second contact surface 19 of the base end of the manipulation handle contacts the seat surface 17 for the handle. The distance $l_1$ between the first contact surface 18 and the pivot shaft 16 is selected to be greater than the distance $l_2$ between the second contact surface 19 and the pivot shaft 16.

A latch support mounting base 20 of the same shape as the embedded case 5 is fitted in the latter. The base 20 is provided on its rear side with an upper and a lower connecting tabs 21 and 22 perpendicular to the rear surface of the base 20. The outer end of the connecting operation rod 12 connected between the connecting tabs 21 and 22 is pivotally secured to the connecting tabs 21 and 22 by means of a pivot shaft 23 extending in parallel with the frame wall 4 through a vertical bore 33. The inner end surfaces 21*a* and 22*a* of the connecting tabs 21 and 22 have arcuate forms centered at the pivot shaft 23. A compression coiled spring 25 is loaded between a washer 24 contacting the connecting tabs and the inner bottom 5*a* of the case, so as to project the operation rod 12 towards the outside of the refrigeration chamber. The latch support 2 of the latch device is fastened to the mounting base 20 by means of screws 26. In this embodiment, the body of the latch device 1 is attached to the door 27.

Figure 7:
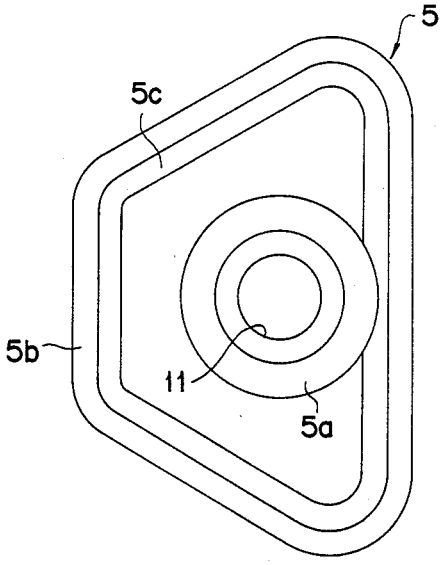
FIG. 7 is a front elevational view of a case embedded in a frame wall.
Figure 8:
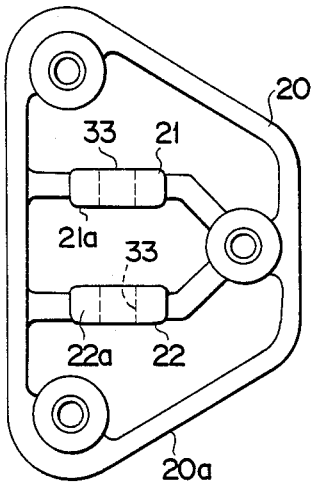
FIGS. 8 and 9 are a rear plan view and a right side elevational view of a support mounting base, respectively.
Figure 9:
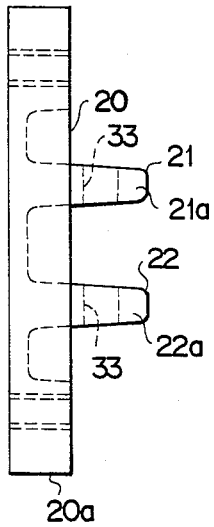
Figure 10:
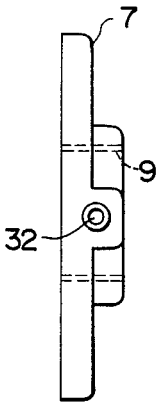
FIGS. 10 and 11 are a right side elevational view and a rear plan view of a handle support, respectively.
Figure 11:
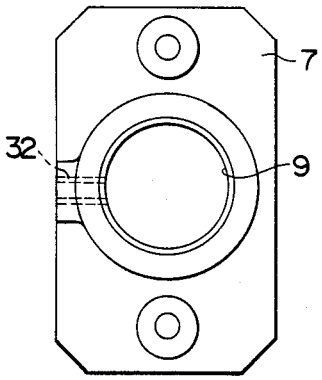
Figure 13:
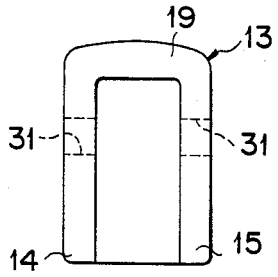
Figure 12:
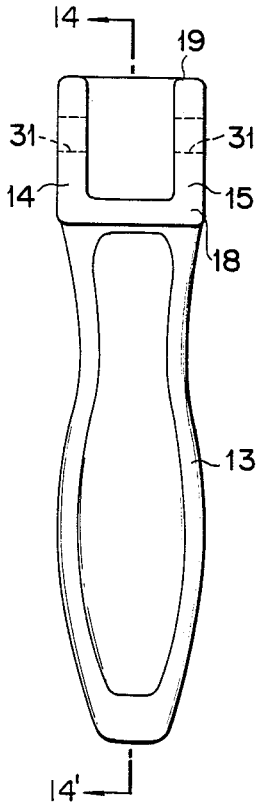
FIGS. 12 and 14 are a front plan view and elevational view respectively, showing a manipulation handle.
Figure 14:
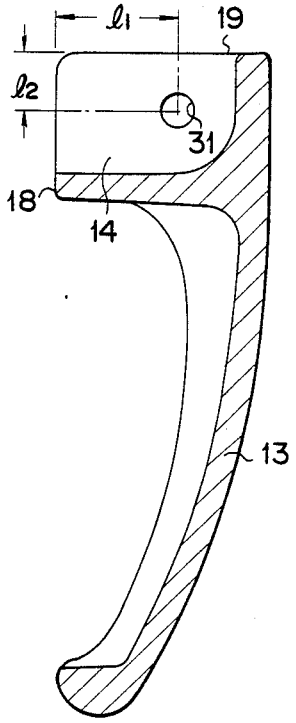

In the normal state of use, that is to say, when the door 27 is closed and latched to the frame wall 4 by an engagement of the latch support 2 and a latch 28 of the latch device, the manipulation handle 13 takes a fallen down position in which the first contact surface 18 of the handle 13 is held in contact with the handle seat surface 17 of the adjusting sleeve 10. When the manipulation handle 13 is moved to this position, the operation rod 12 is fully retracted towards the inside of the chamber while compressing the coiled 25, spring and the base 20 is pulled into the embedded case 5 such that a half part of the periphery 20*a* of the base 20 emerges from the case 5. Since the outer peripheral portion 20*a* of base 20 is surrounded by the non-circular peripheral wall 5*b* of the case 5 having a similar form to the outer peripheral portion 20*a* as seen in FIG. 7, the base 20 and the latch support 2 are prevented from rotating. In addition, any rock or jolt of the base 20 and the latch support 2 are avoided due to the contact of the latch support and mounting base portion 20*a* with the stepped surface 5*c* on the inner peripheral surface of the embedded case 5. Thus, the latch support 2 is securely and stably held by the frame wall 4 of the chamber to cooperate with the latch 28 on the latch device 1 to form and maintain a latch region for latching the door 27 on the frame 4 of the chamber wall. The ordinary unlatching and opening of the door 27 is made by means of an outdoor manipulation handle 29.

Figure 5:
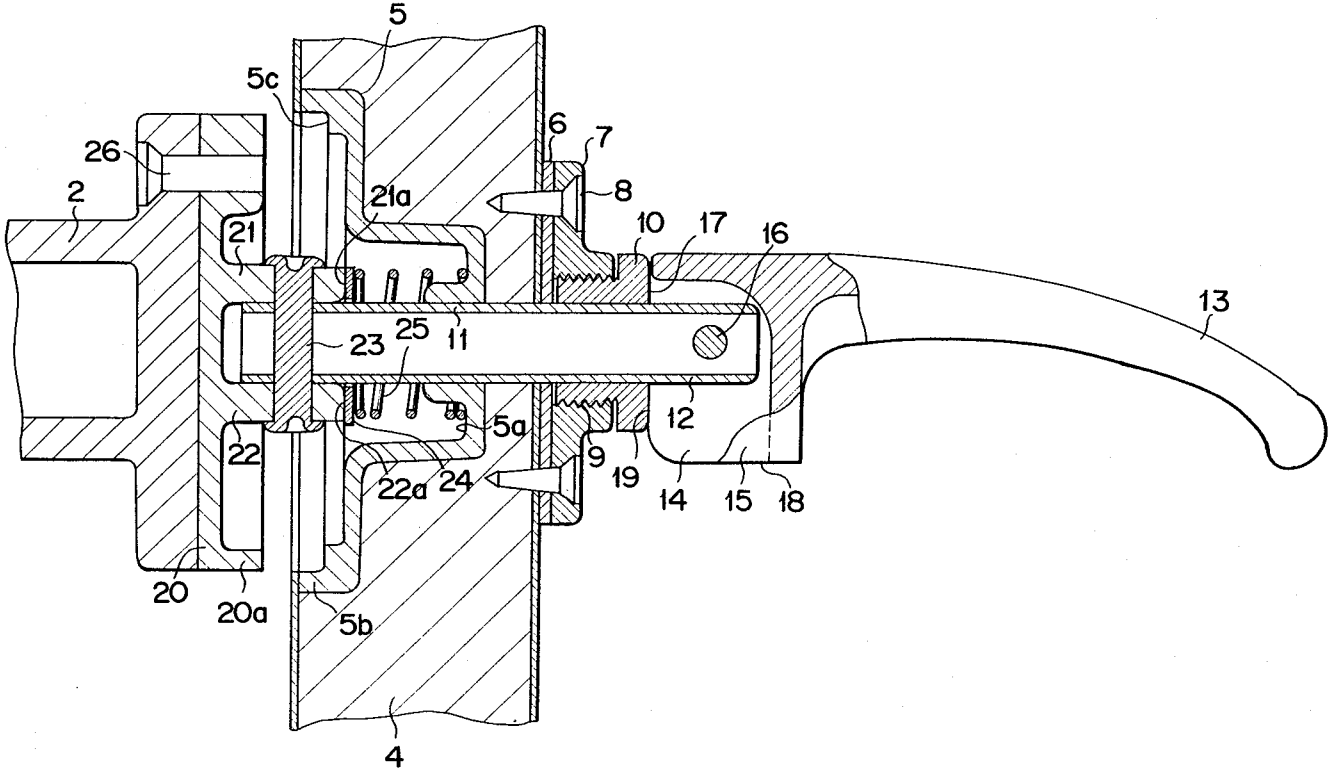
FIG. 5 is a sectional view corresponding to that in FIG. 3, but showing the state in which a manipulation handle is pulled towards the operator in the case of an emergency.

In an emergency, such as an accidental confinement of a worker in the refrigeration chamber, the worker can escape by manipulating the indoor manipulation handle 13. This can be made simply by pulling and swinging the handle 13 through a 90° angle from the position fallen down on the frame wall 4 to a position perpendicular to the frame wall 4 as shown in FIG. 5. By swinging the manipulation handle 13 in the manner described, the first contact surface 18 of the handle base is disengaged from the handle seat surface 17 and second contact surface 19 is brought into contact with the handle seat surface 17 at the end of the swinging motion. Since the distance $l_2$ between the second contact surface 19 and the pivot shaft 16 is smaller than the distance $l_1$ between the pivot shaft 16 and the first contact surface 18, the operation rod 12 is slidingly moved towards the outside of the chamber by a distance $l_1$-$l_2$ by the reactional force of the coiled compression spring 25.

Figure 6:
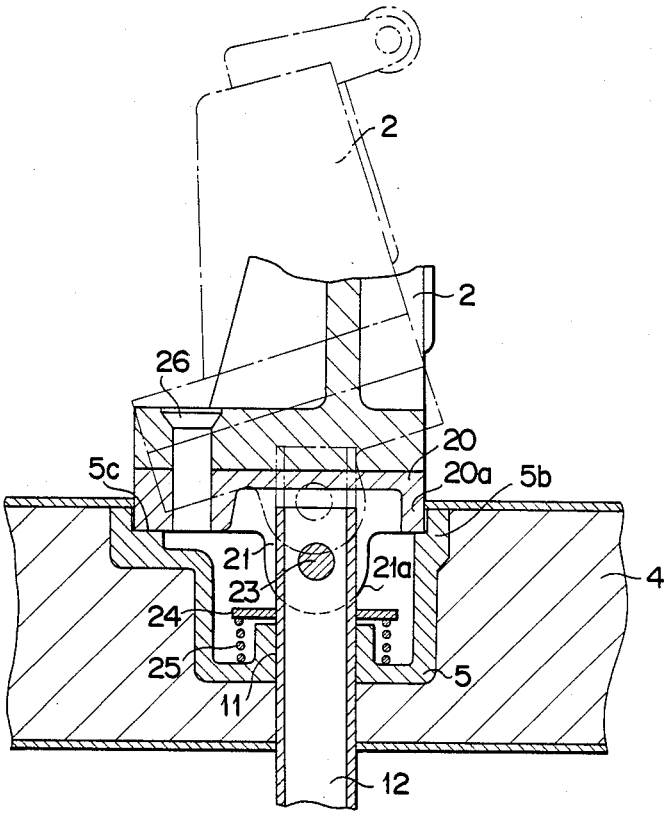
FIG. 6 is a cross-sectional view taken along the line 6—6 in FIG. 1 showing a latch support in a tilted or unlatched state.

As a result of this outward sliding motion, the mounting base 20 comes out of the embedded case 5 to permit the base 20 to rotate around the pivot shaft 23 mentioned before. Then, as the door 27 is pushed from the indoor side, the latch support 2 is pressed by the latch 28 so that the base 20 fixed to the latch support 2 is rotated or tilted out of engagement with the latch 28 as shown in FIG. 6. As a result, the latch 28 of the door 27 is disengaged to allow the worker to open the door from the indoor side.

In the described embodiment, the base 20 to which the latch support 2 is fixed is pivotally connected at pivot shafts 23 to the outer end of the operation rod 12. This, however, is not exclusive and the latch support 2 may be pivotally connected to the operation rod directly. It is also possible to integrally fix the latch support 2 and the base 20 to the outer end of the operation rod 12, instead of connecting them pivotally to the operation rod 12. In this case, the removal of engagement between the latch 28 and the latch support 2 is made, instead of the tilting of the latch supported explained before, by a rotation of the latch support along the outer surface of the frame wall and around the operation rod or, alternatively, by increasing the amount of lift of the latch support 2 through increasing the difference of distances between the pivot shaft 16 and respective contact surfaces 18 and 19.

As has been described, the invention provides an unlatched device for a latch device of a door of a refrigeration chamber or the like, comprising an operation rod 12 extending through the frame wall 4 of said door betwen the exterior and interior of said refrigeration chamber or the like, said operation rod being connected at its outer end to a latch support 2 of said latch device 1 directly or indirectly; and a manipulation handle 13 connected to the inner end of said operation rod 12 by means of a pivot shaft 16 extending in parallel with said frame wall 4, said manipulation handle having a first contact surface 18 and a second contact surface 19 selectively contactable with a handle seat 17 surface adjacent to the inner surface of said frame wall, the distance $l_1$ between said first contact surface 18 and said pivot shaft 16 being greater than the distance $l_2$ between said pivot shaft 16 and said second contact surface 19, wherein, in the normal state, said first contact surface 18 is held in contact with said handle seat surface 17 to pull and hold said latch support 2 on the outer surface of said frame wall 4, while in an emergency, said manipulation handle 13 is rotated to bring said second contact surface 19 into contact with said handle seat surface 17 to lift said latch support 2 away from said outer surface of said frame wall 4, thereby to disengage said latch support 2 from a latch 28 of said latch device 1.

Thus, in contrast to the conventional unlatching device in which a large number of rotations for a nut on a threaded rod is required for retracting or removing the nut, the unlatching device of the invention permits an easy unlatching by a simple and single action of swinging the manipulation andle 13. The worker, who has been accidentally confined in the refrigeration chamber, can easily and promptly escape without any substantial feel of fear or confusion.

As has been described, the invention can be embodied in various forms. If the first and second contact surfaces 18 and 19 are formed on the base end of the elongated handle as in the described embodiment, a large driving force is applied to the operation rod 12 through a lever action of the handle so that the device can operate with sufficiently small force by breaking ice easily by the operation rod 12 or the like. In addition, by connecting the latch support 2 and the mounting base 20 pivotally to the outer end of the operation rod 12 as in the described embodiment, it is possible to reduce the outward sliding length of the operation rod 12 required for the disengagement of the latch support 2 and the latch 28 from each other. This means that the difference $l_1$-$l_2$ of the distances between the first and second contact surfaces and the pivot shaft is reduced to permit a reduction in the rotational manipulating force of the manipulation handle 13.

Furthermore, in the described embodiment, the latch support 2 is automatically disengaged from the latch 28 by the swinging of the manipulation handle 13 to further facilitate and simplify the unlatching operation, thanks to the provision of the compressed coiled spring 25 between the latch support mounting base 20 and the latch support or the inner bottom 5*a* of the embedded case 5 so as to outwardly and slidably bias the operation rod 12.

In addition, in the described embodiment of the invention, the base 20 is fitted in the embedded case 5 and the operation rod 12 having a non-circular form is received by a guide hole having the same cross-sectional shape, so that the freedom for the swinging motion of the manipulation handle along the frame wall 4 is obviated to limit te motion of the handle 13 only to the swinging motion toward and away from the frame wall 4. The worker confined in the refrigeration chamber, therefore, can make the necessary unlatching operation without doubt or confusion and can escape without delay.

Finally, it is to be noted that, since the handle bottom surface 17 is constituted by the inner end surface of the adjusting sleeve 10 screwed into the central threaded bore in the handle support 7, the unlatching device of the invention can be applied to various doors of different thicknesses for the refrigeration chambers or the like by suitably adjusting the amount of screwing of the adjusting sleeve 10 in the central threaded hole 9.

What is claimed is:

1. An unlatching device for a latch device for a door of a chamber, comprising: an operation rod extending through a frame wall for the door between the exterior and interior of said chamber, said operation rod being pivotally connected at its outer end to a mounting base fitted in a case and a latch support of said latch device; and a manipulation handle pivotally connected to the inner end of said operation rod by means of a pivot shaft extending in parallel with said frame wall, said manipulation handle having a first contact surface and a second contact surface selectively contactable with a handle seat surface adjacent to the inner surface of said frame wall, the distance between said first contact surface and said pivot shaft being greater than the distance between said pivot shaft and said second contact surface, wherein the position of said handle seat surface relative to the manipulation handle is adjustable by adjusting sleeve means, and in the normal state, said first contact surface is held in the contact with said handle seat surface to pull and hold said latch support on the outer surface of said frame wall, while in an emergency said manipulation handle is rotated about said pivot shaft to bring said second contact surface into contact with said handle seat surface so as to lift said latch support away from said outer surface of said frame wall, thereby to disengage said latch support from a latch of said latch device and allow opening the door.

2. An unlatching device for a latch device for a door of a chamber, comprising: an operation rod extending through a frame wall for the door between the exterior and interior of said chamber, said operation rod being pivotally connected at its outer end to a mounting base fitted in a case and a latch support of said latch device; wherein said operation rod is pivotally connected at its outer end to said mounting base by dual connecting tabs, and a compression spring is provided between said connecting tabs and said case; and a manipulation handle pivotally connected to the inner end of said operation rod by means of a pivot shaft extending in parallel with said frame wall, said manipulation handle having a first contact surface and a second contact surface selectively contactable with a handle seat surface adjacent to the inner surface of said frame wall, the distance between said first contact surface and said pivot shaft being greater than the distance between said pivot shaft and said second contact surface, wherein the normal state, said first contact surface is held in contact with said handle seat surface to pull and hold said latch support on the outer surface of said frame wall, while in an emergency said manipulation handle is rotated about said pivot shaft to bring said second contact surface into contact with said handle seat surface so as to lift said latch support away from said outer surface of said frame wall, thereby to disengage said latch support from a latch of said latch device and allow opening the door.

3. An unlatching device for a latch device for a door of a chamber, comprising: an operation rod extending through a frame wall for the door between the exterior and interior of said chamber, said operation rod being pivotally connected at its outer end to a mounting base of a latch support of said latch device by a pivot shaft extending in parallel with said frame wall, said mounting base being fitted in a case embedded within an outer side of said frame wall; a handle support attached to an inner surface of said frame wall; an adjusting sleeve screwed to a threaded hole formed in said handle support, an inner end surface of said adjusting sleeve constituting a handle seat surface; a manipulation handle pivotally connected to the inner end of said operation rod by a pivot shaft extending in parallel with said frame wall, said manipulation handle having a first contact surface and a second contact surface selectively contactable with said handle seat surface, the distance between said first contact surface and said pivot shaft being greater than the distance between said second contact surface and said pivot shaft, the position of said handle seat surface relative to the manipulation handle is adjustable by adjusting the amount of screwing of said adjusting sleeve in said threaded hole, wherein the normal state, said first contact surface is held in contact with said handle seat surface to pull and hold said latch support on the outer surface of said frame wall, while in an emergency, said manipulation handle is rotated about said pivot shaft to bring said second contact surface into contact with said handle seat surface so as to lift said latch support away from said outer surface of said frame wall, thereby to disengage said latch support from a latch of said latch device and allow opening the door.

4. An unlatching device for a latch device for a door of a chamber, comprising: an operation rod extending through a frame wall for the door between the exterior and interior of said chamber, said operaton rod being pivotally connected at its outer end to connecting tabs provided on a rear side of a mounting base of a latch support by a pivot shaft extending in parallel with said frame wall, said mounting base being fitted in a non-circular case embedded within an outer side of said frame wall; a compression spring loaded between a washer contacting with arcuate inner end surfaces of said connecting tabs and an inner bottom of said case; a manipulation handle pivotally connected to the inner end of said operating rod by a pivot shaft extending in parallel with said frame wall, said manipulation handle having a first contact surface and a second contact surface selectively contactable with said handle seat surface, the distance between said first contact surface and said pivot shaft being greater than the distance between said second contact surface and said pivot shaft, wherein in the normal state, said first contact surface is held in contact with said handle seat surface to pull and hold said latch support on the outer surface of said frame wall, and when, in an emergency, said manipulation handle is rotated about said pivot shaft to bring said second contact surface into contact with said handle seat surface, said spring tilting each latch support away from said outer surface of said frame wall, thereby to disengage said latch support from a latch of said latch device and allow opening the door.

* * * * *